US008540508B2

(12) United States Patent
Prade

(10) Patent No.: US 8,540,508 B2
(45) Date of Patent: Sep. 24, 2013

(54) METHOD FOR THE COMBUSTION OF A FLUID FUEL, AND BURNER, ESPECIALLY OF A GAS TURBINE, FOR CARRYING OUT SAID METHOD

(75) Inventor: Bernd Prade, Mülheim an der Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 1740 days.

(21) Appl. No.: 10/568,119

(22) PCT Filed: Aug. 5, 2004

(86) PCT No.: PCT/EP2004/008786

§ 371 (c)(1),
(2), (4) Date: Feb. 13, 2006

(87) PCT Pub. No.: WO2005/019734

PCT Pub. Date: Mar. 3, 2005

(65) Prior Publication Data

US 2006/0260322 A1 Nov. 23, 2006

(30) Foreign Application Priority Data

Aug. 13, 2003 (EP) ..... 03018417

(51) Int. Cl.
*F23C 5/00* (2006.01)

(52) U.S. Cl.
USPC ..... 431/8; 431/268; 431/115; 431/7; 431/11; 431/170; 60/777; 60/723; 60/776; 502/304; 502/303; 502/339

(58) Field of Classification Search
USPC ..... 431/8, 268, 115, 7, 11, 170, 326, 431/116; 60/777, 723, 776; 502/304, 303, 502/339
See application file for complete search history.

(56) References Cited

U.S. PATENT DOCUMENTS

| | | | | | |
|---|---|---|---|---|---|
| 4,040,252 | A | * | 8/1977 | Mosier et al. | 60/804 |
| 4,421,476 | A | * | 12/1983 | Gulden et al. | 431/243 |
| 4,692,306 | A | * | 9/1987 | Minet et al. | 422/49 |
| 4,731,989 | A | * | 3/1988 | Furuya et al. | 60/775 |
| 5,355,668 | A | * | 10/1994 | Weil et al. | 60/777 |
| 5,634,784 | A | * | 6/1997 | Pfefferle et al. | 431/7 |
| 6,015,285 | A | * | 1/2000 | McCarty et al. | 431/7 |

(Continued)

FOREIGN PATENT DOCUMENTS

| | | |
|---|---|---|
| EP | 0 491 481 A1 | 6/1992 |
| EP | 0 832 399 B1 | 4/1998 |

(Continued)

*Primary Examiner* — Avinash Savani

(57) ABSTRACT

The invention relates to a method for burning a fluid fuel, in which fuel is reacted in a catalytic reaction, whereupon catalytically pre-reacted fuel continues to be burned in a secondary reaction. A swirling component is impressed onto the pre-reacted fuel, allowing the secondary reaction to be ignited in a spatially controlled manner, resulting in complete burnout. The invention further relates to a burner for burning a fluid fuel, in which the fuel outlet of a catalytic burner is disposed upstream of the fuel outlet of a primary burner in the direction of flow of the fuel within a flow channel such that the fuel is catalytically reacted. The catalytic burner is provided with a number of catalytically effective elements which are arranged such that a vortex is created in the flow channel. The invention can be applied particularly to combustion chambers of gas turbines.

19 Claims, 2 Drawing Sheets

(56) References Cited

U.S. PATENT DOCUMENTS

| | | | | |
|---|---|---|---|---|
| 6,048,194 | A * | 4/2000 | Pfefferle et al. | 431/115 |
| 6,237,343 | B1 | 5/2001 | Butler | |
| 6,279,323 | B1 * | 8/2001 | Monty et al. | 60/752 |
| 6,339,925 | B1 * | 1/2002 | Hung et al. | 60/777 |
| 6,488,016 | B2 * | 12/2002 | Kavonius | 123/538 |
| 2002/0182555 | A1 | 12/2002 | Carroni et al. | |

FOREIGN PATENT DOCUMENTS

| | | | |
|---|---|---|---|
| EP | 0 953 806 | A2 | 11/1999 |
| EP | 0832397 | B1 | 1/2000 |
| EP | 1 359 377 | A1 | 11/2003 |
| EP | 1359377 | A1 | 11/2003 |
| JP | S61-276627 (A) | | 6/1986 |
| JP | 62141425 | A | 6/1987 |
| WO | WO 03/072919 | A1 | 9/2003 |

* cited by examiner

METHOD FOR THE COMBUSTION OF A FLUID FUEL, AND BURNER, ESPECIALLY OF A GAS TURBINE, FOR CARRYING OUT SAID METHOD

CROSS REFERENCE TO RELATED APPLICATIONS

This application is the US National Stage of International Application No. PCT/EP2004/008786, filed Aug. 5, 2004 and claims the benefit thereof. The International Application claims the benefits of European Patent application No. 03018417.0 EP filed Aug. 13, 2003. All of the applications are incorporated by reference herein in their entirety.

FIELD OF THE INVENTION

The invention relates to a method for burning a fluid fuel, in which fuel is reacted in a catalytic reaction, whereupon catalytically pre-reacted fuel continues to be burned in a secondary reaction. The invention further relates to a burner for burning a fluid fuel, in which the fuel outlet of a catalytic burner is disposed upstream of the fuel outlet of a primary burner in the direction of flow of the fuel within a flow channel, such that the fuel is catalytically reacted. The invention further relates to a combustion chamber which has such a burner and to a gas turbine comprising such a combustion chamber.

BACKGROUND OF THE INVENTION

A fluid fuel is understood hereinbelow to refer especially to fuel oil and/or fuel gas, as used especially for gas turbines. Fuel oil is understood to refer to all combustible liquids, e.g. mineral oil, methanol, etc. and fuel gas is understood to refer to all combustible gases, e.g. natural gas, coal gas, synthesis gas, biogas, propane, butane, etc. Such burners involving a catalytic reaction are disclosed for example in document EP-A-491 481.

Such burner systems are also suitable for applications in turbomachines such as, for example, gas turbines. A gas turbine normally consists of a compressor part, a burner part and a turbine part. The compressor part and the turbine part are normally located on a common shaft which simultaneously drives a generator for generating electricity. In the compressor part, pre-heated fresh air is compressed to the pressure required in the burner part. In the burner part, the compressed and pre-heated fresh air is burned with a fuel such as e.g. natural gas or fuel oil. The hot burner exhaust gas is fed to the turbine part and pressure is released there such that work is performed.

When the compressed and preheated fresh air is burned with the fuel gas, pollutants, for example nitrogen oxides $NO_x$ or carbon monoxide CO, emerge as particularly undesirable combustion products. The nitrogen oxides are deemed along with sulfur dioxide to be a principal causal agent of the environmental problem of acid rain. There is therefore the determination—also on account of strict legal thresholds specified for $NO_x$ emission—to keep the $NO_x$ emission of a gas turbine especially low and at the same time not to affect the performance of the gas turbine to any great extent.

Thus, for example, reducing the flame temperature or the peak flame temperature in the burner part has the effect of reducing the nitrogen oxides. To do this, steam is fed into the fuel gas or the compressed and preheated fresh air or water is sprayed into the combustion chamber. Such measures which reduce per se a nitrogen oxide emission of the gas turbine, ate referred to as primary measures for reducing nitrogen oxides. Correspondingly, all measures in which nitrogen oxides contained at one time in the waste gas of a gas turbine—or of a combustion process in general—are reduced by means of subsequent measures are referred to as secondary measures.

The method of selective catalytic reduction (SCR), in which the nitrogen oxides together with a reducing agent, preferably ammonia, are bonded to a catalyst, thereby forming harmless nitrogen and water, has come to be used worldwide for this purpose. The use of this technology however, necessarily involves the consumption of reducing agents. The catalytic converters for nitrogen oxide reduction disposed in the exhaust-gas duct cause by their nature a fall in pressure in the exhaust-gas duct which brings with it a decline in output of the turbine. Even a decline in output of the order of a few parts per thousand has a severe impact, where the gas turbine has an output of, for example, 150 MV and an electricity selling price of approximately 8 cents per kWh of electricity, on the profit achievable with such a plant.

Recent thoughts on burner design tend toward replacing a customary diffusion burner normally used in the gas turbine or a swirl-stabilized premix burner with a catalytic combustion system. With a catalytic combustion system, lower nitrogen oxide emissions are achieved simply by virtue of the combustion process as such than is possible with the conventional types of burner mentioned above. The known disadvantages of the SCR method (large volumes of catalysts, consumption of reducing means, marked loss of pressure) can in this way be overcome.

One application of a catalytic process is disclosed in EP 0 832 397 B1, for example, which shows a catalytic gas turbine burner. Here, a part of the fuel gas is drawn off by means of a conduit system, routed via a catalytic stage and then fed into the fuel gas again in order to reduce its catalytic ignition temperature. The catalytic stage is fashioned here as a preforming stage which comprises a catalytic converter installation which is provided for converting a hydrocarbon contained in the fuel gas into an alcohol and/or an aldehyde or $H_2$ and CO.

EP 0 832 399 B1 discloses a burner for burning a fuel in which the fuel outlet of a catalytic auxiliary burner to stabilize the main burner with the catalytic combustion of a pilot fuel flow is provided upstream of the fuel outlet of the main burner in the direction of flow of the fuel within a flow channel. In this case, the catalytic auxiliary burner is disposed centrally and the main burner coronally relative to the cross-section of the flow channel for the fuel.

The catalytic combustion systems described hereinabove consist here of a catalytic converter which is disposed axially. Only a part of the energy contained in the fuel is released in the catalytic converter, as a result of which stabilization of the burnout of the remaining part of the chemically bound energy is improved in a combustion space in an axial direction downstream of the catalytic converter. This primary reaction commences after a certain period, known as the autoignition time, which depends essentially on the temperature and the composition of the gas at the catalytic converter outlet.

The use of such known arrangements for operation with markedly different fuels is usually a problem in this context, since the catalytic converter generally has to be specifically adapted for certain fuels. In particular, this also makes it difficult to use a catalytic converter which has been designed for natural gas as a reactor for converting long-chain hydrocarbons (in particular, therefore pre-evaporated fuel oil) since the corresponding reaction kinetic properties are significantly different. Such arrangements are therefore only of limited suitability for enabling operation of the gas turbine with a liquid fuel.

SUMMARY OF THE INVENTION

The object of the invention is to indicate a method for burning a fluid fuel by means of which as complete a conversion as possible of the fluid fuel can be achieved with low levels of pollutant emissions. A further object of the invention is to indicate a burner, especially for a gas turbine, which is suitable for carrying out said method.

The method-oriented object is achieved according to the invention in a method for burning a fluid fuel, in which fuel is reacted in a catalytic reaction, whereupon catalytically pre-reacted fuel continues to be burned in a secondary reaction, a swirling component being impressed onto the pre-reacted fuel.

The invention is based upon the recognition that the secondary reaction commences only after a certain time which depends essentially on the temperature and the gaseous composition of the reaction products after the catalytic reaction. The secondary reaction which follows the catalytic reaction is intended to be such that maximum possible conversion into heat occurs. To achieve this, the fuel which continues to be burned in the secondary reaction must burn out completely, while carbon monoxide and hydrocarbons in the waste gas are to be avoided.

The invention is based here on the consideration that e.g. fluid fuels like fuel oil which cannot reliably be reacted in a catalytic reaction, or only inadequately so, cannot generally be caused to burn out completely in a reaction of limited volume, unless an aerodynamic stabilization takes place. There is also the problem with practicable existing dimensions that even with partial catalytic conversion the reaction times available for the secondary reaction after deducting the autoignition time are too short for CO-free combustion.

The invention now indicates a completely new way of achieving the combustion of a fluid fuel whereby the catalytic reaction and the secondary reaction are matched to one another in a targeted manner in order to complete the burning out of the fuel. A fluid fuel can also preferably be a fuel/air mix which is obtained by mixing the fluid fuel with combustion air to form a fuel/air mix which is catalytically reacted. To this end, it is proposed that a swirling component be impressed onto the pre-reacted fuel or a pre-reacted fuel/air mix from the catalytic reaction. Swirling the pre-reacted fuel achieves the result that more reaction time is available for the fuel escaping the catalytic reaction than was the case in a swirl-free, i.e. purely axial reaction coordinate of conventional catalytic combustion systems. Due to the swirling, the pre-reacted fuel will reach the autoignition time—viewed in an axial coordinate—on a significantly reduced pathway because the axial velocity component of the pre-reacted fuel is reduced by the swirling and a circumferential velocity component induced by the swirling is produced, and above all a backflow zone is generated. Consequently, sufficient reaction volume is available for the secondary reaction in which the pre-reacted fuel continues to be burned so that the fuel can be caused to burn out completely—with no any increase worth mentioning in the axial structural space of the combustion system.

Thus, with partial catalytic conversion a significantly greater reaction time is available for secondary reaction after the autoignition time has been deducted compared with conventional catalytic combustion systems, so that, in particular, complete combustion is achieved CO-free. With conventional systems without swirl being applied, a considerable enlargement of the structural length of the burnout space for the secondary reaction is required, which makes such systems very demanding in terms of design, cost-intensive and difficult to manage. These disadvantages can now be overcome with the present invention, in that different fluid fuels, i.e. both liquid and gaseous fuels, can be used in the method, it being possible, if required, for liquid fuels also to be burned conventionally in the form of a swirl-stabilized flame, with the catalytic converter being bypassed.

In an advantageous embodiment, the pre-reacted swirl-subjected fuel is transferred for the secondary reaction in a combustion space, a vortex being created.

A spatially controlled ignition of the secondary reaction in the combustion chamber is preferably brought about by adjusting the dwell time of the pre-reacted fuel for the transfer. The dwell time can be adjusted here by adjusting the swirl and the fabrication of the vortex caused as a result, with regard to the amount and direction of the fuel flow. In this way, the autoignition time can readily be fixed spatially at least on average relative to a dwell time distribution of the swirl-subjected reaction products of the catalytic reaction, and consequently sufficient stabilization of the burnout for the secondary reaction ensured.

Preferably, a homogeneous non-catalytic secondary reaction is ignited as a secondary reaction. The fuel is preferably also burned completely in the secondary reaction. Consequently, a catalytic pre-reaction is advantageously combined with a non-catalytic secondary reaction, a spatially controlled ignition of the homogeneous non-catalytic secondary reaction being ensured by the swirling component of the catalytically pre-reacted fuel or of a liquid fuel possibly sprayed in if required downstream of the catalytic converter.

In a preferred embodiment, a gaseous fuel or a liquid fuel, especially fuel gas or fuel oil, is burned as a fluid fuel.

The second-mentioned burner-oriented object is achieved according to the invention in a burner for burning a fluid fuel in which the fuel outlet of a catalytic burner is disposed upstream of the fuel outlet of a primary burner in the direction of flow of the fuel within a flow channel, such that the fuel is catalytically reacted, the catalytic burner having a number of catalytically effective elements which are arranged such that a vortex is created in the flow channel.

The direction of flow of the fuel within the flow channel refers here to the axial direction of flow along the flow channel which is determined by a longitudinal axis of the flow channel. The vortex which is created as a result of the arrangement of catalytically effective elements should be understood to be a vortex or swirl-subjected flow about the direction of flow or primary direction of flow of the fuel within the flow channel.

In this context, the vortex is preferably created in the wake of the catalytically effective elements downstream of the fuel outlet thereof, in that, for example, the fuel outlet discharges into the flow channel perpendicular to a longitudinal axis of the flow channel, the fuel outlet being disposed offset in relation to the longitudinal axis such that a swirl is generated. The creation of a vortex or swirling flow in the wake of the catalytically effective elements-impresses a swirling component onto the fluid fuel in a targeted manner such that a (moderate) circumferential velocity component is generated and the axial velocity component along the longitudinal axis, i.e. along the direction of flow of the fuel within the flow channel, is reduced in accordance with the amount of swirl provided by the geometric arrangement of the catalytically effective elements.

In a particularly preferred embodiment, the catalytically effective elements are arranged in a plane perpendicular to the direction of flow, the fuel outlet of the catalytically effective elements discharging into the flow channel. It is possible here for a plurality of catalytically effective elements to be arranged along a periphery of a circle in the plane perpendicular to the direction of flow, a tangential component in the flow into the flow channel being achievable through the direction of the discharge of the fuel outlets in each case. An appropriate number and arrangement of the catalytically effective elements, which in their totality form the catalytic burner for catalytic conversion of the fuel, can fabricate the vortex in a predetermined manner such that a desired dwell time distribution in the combustion chamber is produced that enables a spatially controlled ignition of a homogeneous non-catalytic secondary reaction. The system can advantageously also be arranged such that, if required, a conventional, i.e. non-catalytic, combustion can also be set where e.g. a liquid fuel is used. Consequently, the burner is also particularly suitable for liquid fuels and thus overcomes the disadvantage of previous catalytic combustion systems, especially for gas turbines, which are known only as single-fuel burners for gaseous fuels.

Preferably the axial length of the flow channel is adapted appropriately in order to set a predetermined dwell time for fuel in the flow channel. Through design of the layout of and adaptation of the length of the flow channel, i.e. of the setting of the distance of the fuel outlet of the primary burner from the fuel outlet of the catalytic burner, an appropriate dwell time can be set for starting up and supporting the combustion of the primary burner, taking into account the vortex as a consequence of the impressed swirl and the relevant autoignition time. The burner can thus be particularly flexibly adapted to the primary reaction commencing after a defined period (autoignition time) in the primary burner, said reaction essentially depending on the temperature and composition of the gas at the fuel outlet of the catalytic burner and taking place as a secondary reaction to the upstream catalytic reaction. On the basis of this targeted adaptation, a complete conversion is possible in the primary reaction.

In a preferred embodiment, a catalytically effective element is fashioned as a honeycomb catalytic converter which has as a basic component at least one of the substances titanium dioxide, silicon dioxide and zirconium oxide.

The honeycomb catalytic converter also preferably has as a catalytically active component a noble metal or metal oxide that has an oxidizing effect on the fluid fuel. These are, for example, noble metals like platinum, rhodium, rhenium and iridium and metal oxides such as e.g. the transitional metal oxides vanadium oxide, tungsten oxide, molybdenum oxide, chromium oxide, copper oxide, manganese oxide and oxides of the lanthanides such as e.g. cerium oxide. Likewise, metal-ion zeolites and spinell-type metal oxides can also be used.

The honeycomb structure of the catalytically effective elements proves particularly advantageous since this is formed by a plurality of channels extending along an axis of the catalytically effective element. This promotes the catalytic reaction because of the increase in the catalytically active surface as a result of the channels and also an evening-out of the flow inside the honeycomb catalytic converter such that a well defined outflow of the catalytically pre-reacted fuel from the fuel outlet is achieved, a swirling component being produced in a correspondingly defined manner upon entry into the flow channel.

In a particularly preferred embodiment, the burner according to the invention is provided in a combustion chamber. The combustion chamber comprises here a combustion space into which the burner projects or discharges, preferably by means of the fuel outlet of the primary burner. The combustion space is adequately dimensioned such that a homogeneous, preferably non-catalytic, primary reaction is set in motion and a complete burnout of the fuel and thus maximum conversion into combustion heat is achieved.

Preferably, such a combustion chamber is suited for use in a gas turbine, a hot combustion gas generated in the combustion chamber serving to drive a turbine part of the gas turbine.

The advantages of a combustion chamber of this type and gas turbine of this type will emerge from the above-mentioned comments with regard to the combustion method and the burner.

BRIEF DESCRIPTION OF THE DRAWINGS

The invention will be explained in detail hereinbelow with reference to drawings, in which in a simplified representation not to scale.

Parts are labeled with the same reference symbols in all the Figures.

DETAILED DESCRIPTION OF THE INVENTION

Figure 1:
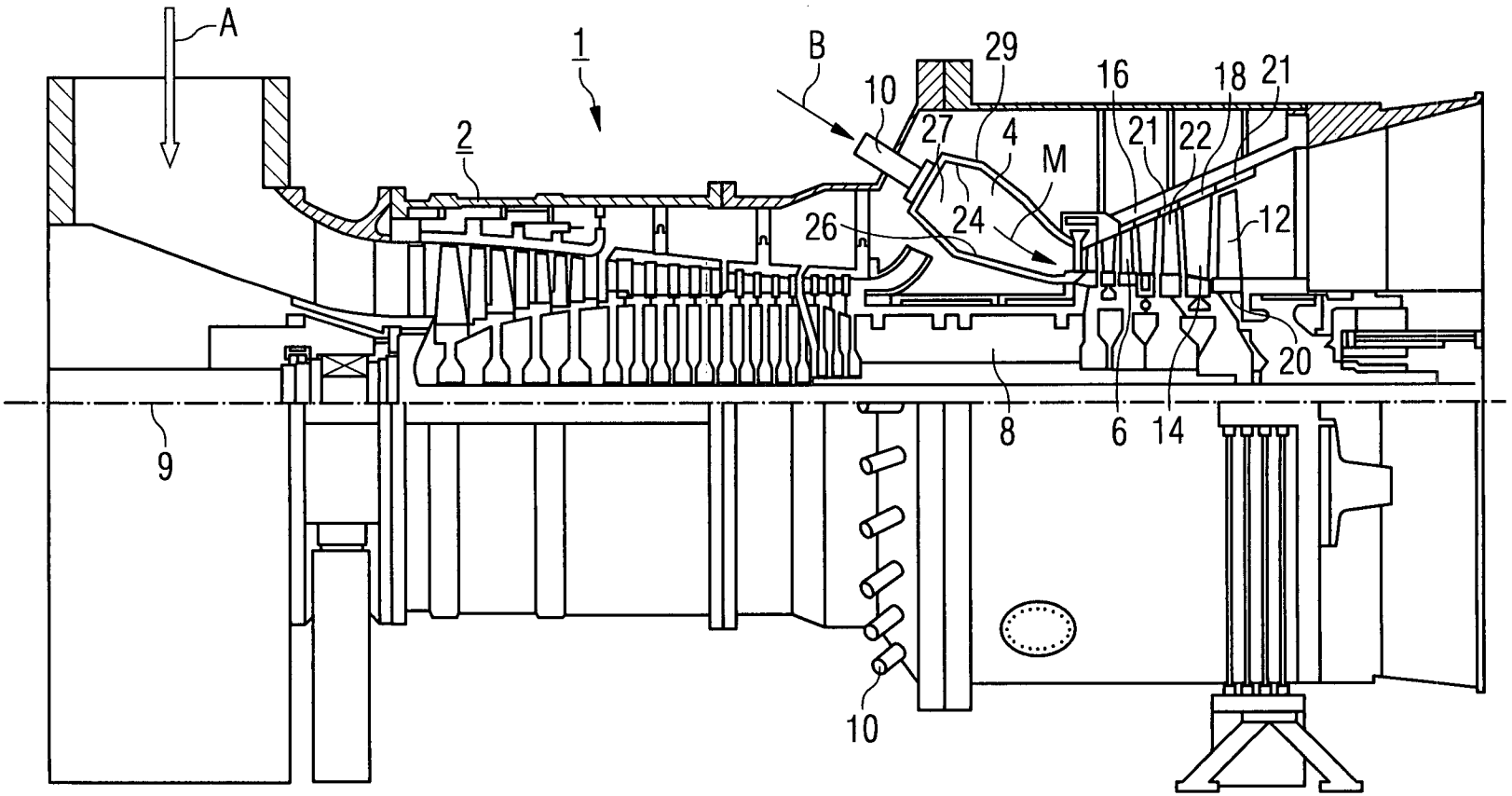
FIG. 1 shows a half section through a gas turbine.

The gas turbine according to FIG. 1 has a compressor 2 for combustion air, a combustion chamber 4 and a turbine 6 for driving the compressor 2 and a generator or a machine not shown in detail. To this end, the turbine 6 and the compressor 2 are arranged on a common turbine shaft 8, also called a turbine rotor, to which the generator or the machine is also connected and which is pivoted about its central axis 9. The combustion chamber 4, fashioned in the manner of an annular combustion chamber, is equipped with a number of burners 10 for burning a liquid or gaseous fuel. The burner 10 is fashioned as a catalytic combustion system and designed for a catalytic and a non-catalytic combustion reaction or combinations thereof. The structure and mode of operation of the burner 10 will be discussed in greater detail in connection with FIGS. 2 and 3.

The turbine 6 has a number of rotatable moving blades 12 connected to the turbine shaft 8. The moving blades are arranged on the turbine shaft 8 in an annular form and thus form a number of rows of moving blades. Furthermore, the turbine 6 comprises a number of fixed guide blades 14 which are likewise fastened in an annular form creating rows of guide blades on an inner housing 16 of the turbine 6. The moving blades 12 serve to drive the turbine shaft 8 by transmitting pulses from the hot medium flowing through the turbine 6, the working medium M. The guide blades 14, in contrast, serve to guide the flow of the working medium M between in each case two consecutive—seen in the direction of flow of the working medium—rows of moving blades or edges of moving blades. A consecutive pair from a ring of guide blades 14 or a row of guide blades 14 and from a ring of moving blades 12 or a row of moving blades is also called a turbine stage. Each guide blade 14 has a platform 18, also called a blade footing, which is arranged as a wall element for fixing the respective guide blade 14 on the inner housing 16 of the turbine. The platform 18 is a thermal, comparatively heavily loaded component which forms the outer limit of a hot-gas duct for the working medium M flowing through the turbine 6. In an analogous manner, each moving blade is fastened via a platform, also called a blade footing, to the turbine shaft. Between the platforms 18 of the guide blades 14 of two adjacent rows of guide blades, spaced at a distance from one another, a guide ring 21 is arranged on the inner housing 16 of the turbine 6. The outer surface of each guide ring 21 is also exposed to the hot working medium M flowing through the turbine 6 and in a radial direction separated from the outer end 22 of the moving blade 12 lying opposite it by a gap. The guide rings 21 arranged between adjacent rows of guide blades serve in particular as cover elements which protect the inner wall 16 or other detachable housing parts from a thermal overload by the hot working medium M flowing through the turbine 6. The combustion chamber 4 is bordered by a combustion chamber housing 29, a combustion chamber wall 24 being formed on the combustion chamber side. In the exemplary embodiment, the combustion chamber 4 is fashioned as a so-called annular combustion chamber in which a plurality of burners arranged in a circumferential direction around the turbine shaft 8 discharge into a common combustion chamber space or combustion space 27. To this end, the combustion chamber 4 is fashioned in its entirety as an annular structure which is positioned around the turbine shaft 8.

In order to produce the hot working medium M, a fluid fuel B and combustion air A are delivered to the burner 10 and mixed to form a fuel/air mix and burned. In order to burn completely and to a large extent low in pollutants, the burner 10 is fashioned as a catalytic combustion system, by means of which a complete conversion of the fuel B can be achieved. The hot gas resulting from the combustion process, the working medium M, has comparatively high temperatures of from 1000° C. up to 1500° C. in order to achieve a correspondingly high level of efficiency of the gas turbine 1. To this end, the combustion chamber 4 is designed for correspondingly high temperatures. In order to enable operation to continue over a comparatively long period even under these operating parameters which are unfavorable for the materials, the combustion chamber wall 24 is fitted on the side facing the working medium M with a combustion-chamber lining formed of heat-shield elements 26. Due to the high temperatures in the interior of the combustion chamber 4, a cooling system, not shown in detail, is also provided for the heat-shield elements 26.

Figure 2:
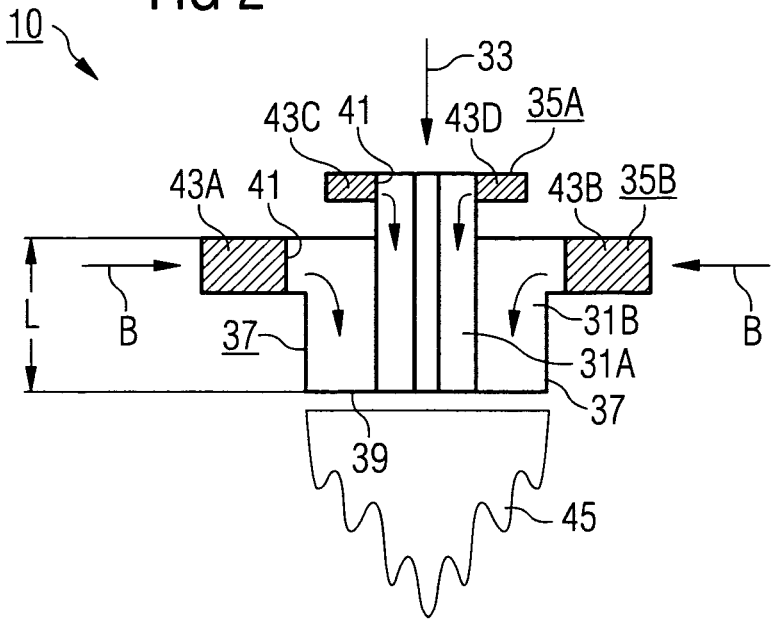
FIG. 2 shows in a sectional view a simplified representation of a burner according to the invention and FIG. 3 the burner represented in FIG. 2 in a view in the primary direction of flow of the fuel.

The burner 10 according to the invention which is used in the combustion chamber 4 of the gas turbine 1 is shown in FIG. 2 in a greatly simplified sectional view in order to explain by way of example the underlying catalytic combustion concept. The burner 10 for burning the fluid fuel B has a catalytic burner 35A, 35B and a primary burner 37. The primary burner 37 comprises a first flow channel 31A and a second flow channel 31B concentrically surrounding the first flow channel. The catalytic burner 35A is assigned to the first flow channel 31A and the catalytic burner 35B to the second flow channel 31B. The flow channel 31A, 31B extends along a primary axis or direction of flow 33. When a fluid fuel B is supplied, the direction of flow 33 is simultaneously the axial direction of flow or main direction of flow of the fuel B into the flow channel 31A, 31B. The catalytic burner 35A has catalytically effective elements 43C, 43D. The catalytic burner 35B has catalytically effective elements 43A, 43B. The catalytically effective elements 43A, 43B, 43C, 43D are fashioned e.g. as honeycomb catalytic converters which consist of a basic component and a catalytically active component, the catalytically active component exerting an oxidizing effect on the fluid fuel B. The catalytically effective elements 43A, 43B are in flow connection with the flow channel 31B, while the catalytically effective elements 43C, 43D are in flow connection with the flow channel 31A. To this end, one fuel outlet 41 respectively of the catalytic burners 35A, 35B discharges into the assigned flow-channel 31A, 31B. The primary burner 37 is disposed downstream of the fuel outlet 41 of the catalytic burner 35A, 35B along the direction of flow 33 of the fuel B and in flow connection with the catalytic burner 35A, 35B via the flow channel 31A, 31B. The primary burner 37 has a fuel outlet 39. Correspondingly, the fuel outlet 41 of the catalytic burner 35A, 35B is provided upstream of the fuel outlet 39 of the primary burner 37 in the direction of flow 33 of the fuel B within the flow channel 31A, 31B. The catalytic burner 35A, 35B serves the catalytic conversion or partial conversion of the fuel B and sets a catalytic pre-reaction in motion which, after an autoignition time, causes an ignition of the pre-reacted fuel B in the primary burner 37. This leads to a stabilization of the burnout and to a completion of the burnout in a burnout zone 45 which is formed in proximity to the fuel outlet 39 of the primary burner 37. In order to set a predetermined dwell time for fuel B in the flow channel 31A, 31B, the length L of the flow channel 31A, 31B is adapted, in particular to the reaction times and flow velocities of the fuel B which have to be taken into consideration. The catalytically effective elements 43A, 43B, 43C, 43D are arranged such that a vortex is created in the flow channel 31A, 31B. This vortex is formed in the wake of the catalytically effective elements 43A, 43B, 43C, 43D downstream of the fuel outlet 41 thereof.

Figure 3:
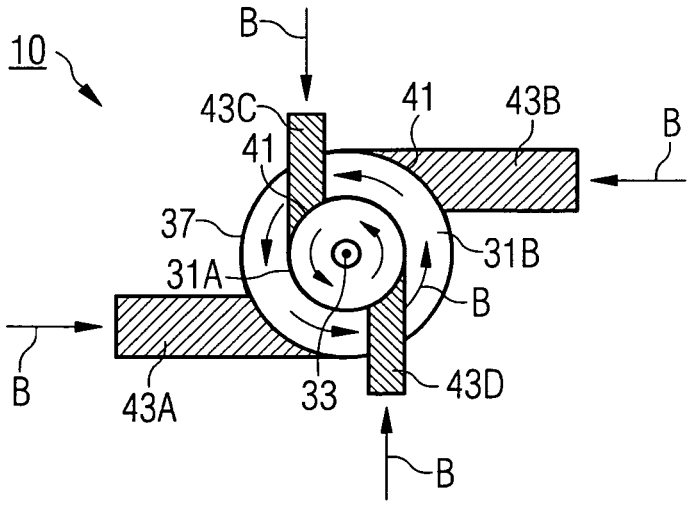

FIG. 3 shows a view along the direction of flow 33 of the burner 10 shown in FIG. 2. The catalytically effective elements 43A, 43B, 43C, 43D are arranged in a plane perpendicular to the direction of flow 33, the fuel outlet 41 of the catalytically effective elements 43A, 43B discharging into the flow channel 31B. Analogously, the catalytically effective elements 43C, 43D are arranged in a plane perpendicular to the direction of flow 33, the fuel outlet 41 of the catalytically effective elements 43C, 43D discharging into the flow channel 31A. The catalytic burners 35A, 35B are arranged along the direction of flow 33 spaced at a distance from one another. As a result of the arrangement of the catalytically effective elements 43A, 43B, when the fluid fuel B flows through the fuel outlet 41 into the annular outer flow channel 31B a swirling component is impressed onto the fluid fuel B. The same applies when the fluid fuel B is fed via the catalytically effective elements 43C, 43D into the inner annular flow channel 31A where a corresponding swirl is impressed onto the fuel B.

When the burner 10 is operating, the fluid fuel B is fed to a catalytic burner 35A, 35B and at least partially reacted there in a catalytic reaction. The fuel B, catalytically pre-reacted in this way, is then burned further in a secondary reaction in the burnout zone 45 of the primary burner. A swirling component is impressed onto the pre-reacted fuel B. In the process, the pre-reacted, swirl-subjected fuel B is transferred for the secondary reaction into a burnout zone 45, the vortex being created in the flow channel 31A, 31B. A spatially controlled ignition of the secondary reaction in the burnout zone 45 is produced by adjusting the dwell time of the pre-reacted fuel B for the transfer. A desired vortex in the flow channel 31A, 31B can be generated by selecting and adjusting the swirling component and in this way, for example—as shown—the axial length L of the flow channel 31B correspondingly fixed. By this means, the structural space, in particular the axial extension, of the burner 10 can be limited to manageable dimensions and at the same time a spatially controlled ignition of the secondary reaction in the burnout zone 45 assigned to the primary burner 37 ensured. The burnout zone 45 is correspondingly limited in its axial dimension due to the vortex of the fluid fuel B so that an implementation comprising normally dimensioned combustion chambers 4 and combustion spaces 27 (cf. FIG. 1) can be achieved, especially for the application in a gas turbine 1. In the burnout zone 45, a homogeneous non-catalytic secondary reaction is ignited which leads to a complete burnout of the fuel B in the catalytic burner 35A, 35B which has already been at least partially pre-reacted.

In the exemplary embodiments shown in accordance with FIG. 2 and FIG. 3, two catalytic burners 35A, 35B are connected in a flow-engineering manner to a respective flow channel 31A, 31B. Implementation of the invention can, however, also be achieved by a burner 10 comprising just one catalytic burner 35A and a flow channel 31A assigned thereto or else comprising a plurality of such burners and assigned flow channels. With the burner 10 according to the invention, it is for the first time possible for a combustion system based on a catalytic combustion process to operate with different fluid fuels B. This means that both liquid and gaseous fuels B can be considered. In this case, the burner 10 can, e.g. when using a liquid fuel, e.g. fuel oil, also be operated, if required, in a conventional operating mode with non-catalytic combustion, which increases the flexibility. For this purpose, the liquid fuel is mixed with combustion air to form a fuel/air mix. A swirling component is preferably impressed in advance onto the combustion air, for example by feeding the combustion air via the swirl-causing catalytic converter elements or via other swirling elements. A liquid fuel is then sprayed into the combustion air downstream of the swirl-causing catalytic converter elements.

Alternatively, by mixing a fluid, in particular a liquid, fuel with combustion air, a fuel/air mix can also be generated which is at least partially reacted in a catalytic reaction and the catalytically pre-reacted fuel/air mix then burned further, a swirling component being impressed onto the pre-reacted fuel/air mix. The burner according to the invention can in this case—depending on the choice of fuel—be operated such that a fluid fuel or fuel/air mix flows through the catalytically effective elements or, particularly in the case of liquid fuels, such that combustion air flows through said elements and the liquid fuel is subsequently sprayed in.

The invention claimed is:

1. A method of combusting a fuel in a catalytic combustion system, comprising:

providing a primary burner having a primary flow channel, the primary flow channel comprises a longitudinal axis and a primary flow channel outlet; and providing a catalytic burner comprising at least a first catalytically effective element disposed in a first catalytic flow path having a first catalytic flow path outlet, the first catalytic flow path predeterminedly arranged to face into the primary flow channel in a approximately circumference direction of the primary flow channel, the first catalytic flow path in fluid communication with the primary flow channel and disposed upstream of the primary flow channel outlet;

pre-reacting fuel supplied by a burner fuel supply in a catalytic pre-reaction by exposing the fuel to the at least first catalytic element;

directing the pre-reacted fuel from the at least first catalytic flow path onto an inner surface of an outer wall that defines an outer perimeter of the primary flow channel such that inner surface of the primary flow channel outer wall is effective to impart a circumferential motion to the pre-reacted fuel in the primary flow channel, causing the pre-reacted fuel to flow in a helical flow path in the primary flow channel; and continuing to burn the pre-reacted fuel in a secondary reaction located in downstream of the pre-reaction and the primary flow channel outlet.

2. The method as claimed in claim 1, wherein the secondary reaction occurs in a vortex downstream of the primary flow channel outlet in a combustion space.

3. The method as claimed in claim 2, wherein the length of the primary flow channel is determined based on a dwell time of the pre-reacted fuel.

4. The method as claimed in claim 3, wherein the primary burner and combustion space are arranged next to each other in sequence along the primary flow channel longitudinal axis.

5. The method as claimed in claim 1, wherein the secondary reaction is a homogeneous non-catalytic reaction.

6. The method as claimed in claim 5, wherein the fuel is completely burned in the secondary reaction.

7. The method as claimed in claim 6, wherein the fuel is a fuel gas or a fuel oil or a mixture of fuel oil and air.

8. The method as claimed in claim 7, wherein the fuel is a fuel gas during a first operating mode of the catalytic combustion system and is a fuel oil or a mixture of fuel oil and air during a second operating mode catalytic combustion system.

9. A burner for burning a fuel, comprising:

a primary burner comprising a primary flow channel, wherein the primary flow channel comprises a longitudinal axis and a primary flow channel outlet; and a catalytic burner comprising a catalytically effective element disposed in a catalytic burner flow channel with a catalytic burner flow channel outlet, the catalytic burner flow channel predeterminedly arranged to face into the primary flow channel in a approximately circumference direction of the primary flow channel, the catalytic burner flow channel arranged to direct pre-reacted fuel onto an inner surface of an outer wall that defines an outer perimeter of the primary flow channel via the catalytic burner flow channel outlet such that the inner surface of a-the primary flow channel outer wall imparts circumferential motion to the pre-reacted fuel effective to create a vortex in the primary flow channel, wherein the fuel is catalytically pre-reacted via exposure to the catalytically effective element.

10. The burner as claimed in claim 9, wherein the fuel is a fuel gas during a first operating mode of the catalytic burner and is a fuel oil or a mixture of fuel oil and air during a second operating mode of the catalytic burner.

11. The burner as claimed in claim 9, wherein the burner comprises a plurality of primary flow channels each sharing a common longitudinal axis, a catalytic burner for each primary flow channel, at least one catalytically effective element per catalytic burner, and a respective inner surface of each primary flow channel respective outer wall imparts circumferential motion to the pre-reacted fuel effective to create a vortex about the common longitudinal axis.

12. The burner as claimed in claim 9, wherein the catalytically effective element is a honeycomb catalytic converter.

13. The burner as claimed in claim 12, wherein the honeycomb catalytic converter basic component is selected from the group consisting of titanium dioxide, silicon oxide and zirconium oxide.

14. The burner as claimed in claim 13, wherein the honeycomb catalytic converter catalytically active component is a noble metal or metal oxide which has an oxidizing effect on the fluid fuel.

15. The burner as claimed in claim 11, wherein the catalytically effective elements that pre-react fuel directed into a respective primary flow channel are arranged in a plane perpendicular to the common longitudinal axis.

16. The burner as claimed in claim 9, wherein the length of the primary flow channel is determined based on a dwell time of the pre-reacted fuel.

17. The burner as claimed in claim 16, wherein the primary burner and a combustion space are arranged next to each other in sequence along the common longitudinal axis.

18. A combustion chamber for a gas turbine engine, comprising:

a combustion chamber housing having an inward side and an outward side;

a combustion chamber wall formed on the inward side of the combustion chamber;

a plurality of heat resistant elements affixed to an interior of the combustion chamber wall that define a combustion air flow channel;

a primary burner having a first primary flow channel comprising a first primary outlet and a second annular flow channel concentric with and surrounding the first primary flow channel and comprising a second annular flow channel outlet, wherein the first and second flow channels comprise a common longitudinal axis and are separated by a common annular wall;

a first catalytic burner comprising: at least a first catalytic burner flow channel having a first catalytic burner flow channel outlet; a first catalytically effective element disposed in the first catalytic burner flow channel; the first catalytic burner flow channel predeterminedly arranged to face into the primary flow channel in a approximately circumference direction of the primary flow channel; the first catalytic flow channel outlet arranged to direct a flow of a first fuel onto an inner surface of the common annular wall that defines an outer perimeter of the primary flow channel, such that the inner surface of the common annular outer wall is effective to impart circumferential motion to the first flow and create a vortex in the primary flow channel about the common longitudinal axis, wherein the first fuel is catalytically pre-reacted by exposure to the first catalytically effective element; and a second catalytic burner comprising: at least a second catalytic burner flow channel with a second catalytic burner flow channel outlet; a second catalytically effective element disposed in the second catalytic burner flow channel; the second catalytic burner flow channel predeterminedly arranged to face into the second annular flow channel in an approximately circumference direction of the annular flow channel and the a second catalytic burner flow channel and the second catalytic burner flow channel outlet arranged to direct a flow of a second fuel onto an inner surface of an outer wall that defines an outer perimeter of the second annular flow channel, such that the inner surface of the a second annular flow channel outer wall is effective to impart circumferential motion to the second flow and create a vortex in the second annular flow channel about the common longitudinal axis, wherein the second fuel is catalytically pre-reacted by exposure to the second catalytically effective element, and wherein subsequently a homogeneous non-catalytic secondary reaction is ignited downstream of the primary burner fuel outlet.

19. The combustion chamber as claimed in claim 18, wherein the fuel is a fuel gas or a fuel oil or a mixture of fuel oil and air.

* * * * *